US005410101A

United States Patent [19]

Sakurai

[11] Patent Number: 5,410,101

[45] Date of Patent: Apr. 25, 1995

[54] PICKUP UNIT FOR ELECTRIC STRING INSTRUMENT

[75] Inventor: Hiroshi Sakurai, Hamamatsu, Japan

[73] Assignee: Yamaha Corporation, Hamamatsu, Japan

[21] Appl. No.: 65,178

[22] Filed: May 20, 1993

[30] Foreign Application Priority Data

May 22, 1992 [JP] Japan ..... 4-041018 U

[51] Int. Cl.[6] ..... G10H 3/18

[52] U.S. Cl. ..... 84/731; 84/DIG. 24

[58] Field of Search ..... 84/731, DIG. 24

[56] References Cited

U.S. PATENT DOCUMENTS 4,314,495 2/1982 Baggs ..... 84/731

4,860,625 8/1989 Mathews ..... 84/731

*Primary Examiner*—Stanley J. Witkowski

*Attorney, Agent, or Firm*—Spensley Horn Jubas & Lubitz

[57] ABSTRACT

In construction of a pickup unit used for electroacoustic conversion of various vibrations produced on a string instrument, a piezoelectric assembly clamped between a string holder and a bridge is provided with a dual layer arrangement of piezoelectric elements kept in contact with corresponding positive electrodes. The piezoelectric elements closer to the string holder detect string vibrations and the piezoelectric elements closer to the bridge detects body vibrations of the string instrument so that electric signals from piezoelectric elements of different groups can be tactfully blended together for rich and voluminous generation of musical tones over a wide tone range.

7 Claims, 2 Drawing Sheets

PICKUP UNIT FOR ELECTRIC STRING INSTRUMENT

BACKGROUND OF THE INVENTION

The present invention relates to a pickup unit for electric string instruments and more particularly relates to improvement in generation of bass range tones by electric string instruments such as electric guitars.

An electric string instrument is generally equipped with a pickup unit which detects string vibrations for conversion into corresponding electric signals. Piezoelectric elements are broadly used for such pickup units as disclosed in Japanese Utility Model Laid-open Hei. 2-27199.

In the construction of the pickup unit of this earlier proposal, a metallic bridge is mounted to a bridge base of an electric guitar to support thereon a metallic string holder. The string holder per se is often called as a bridge too. The string holder holds a plurality of strings arranged in tension on the bridge base. A bimorph type piezoelectric assembly is clamped directly between the string holder and the bridge.

The bimorph type piezoelectric assembly is made up of a pair of piezoelectric sheets clamping a metallic board which forms a common positive electrode. Since the piezoelectric assembly is clamped directly between the bridge and the string holder, string vibrations can be transmitted to the piezoelectric assembly from the string holder without any damping effect. This direct transmission system assures highly sensitive detection of the string vibrations with a high degree of fidelity.

Despite such an ideal detection of string vibrations, the pickup unit of this earlier proposal is unable to successfully detect bass range tones which are generated via body vibrations of an electroacoustic guitar. In order to cover this deficit, it is proposed to arrange a guitar microphone, i.e. an acoustic sensor, within the body of an electroacoustic guitar. This acoustic sensor picks up vibrations of the surface board of the electroacoustic guitar. With increase in volume of tones generated at a guitar amplifier, however, the body of the acoustic sensor tends to resonates with body vibration of the electroacoustic guitar, thereby inevitably causing harsh howling.

SUMMARY OF THE INVENTION

It is thus the basic object of the present invention to effectively pick up bass range tones on an electric string instrument without the problem of harsh howling in final tone generation In accordance with the basic aspect of the present invention, a piezoelectric assembly in a dual layer arrangement is clamped between a bridge and a string holder. The piezoelectric assembly in made up of a first group of aligned piezoelectric elements, a second group of similarly aligned piezoelectric elements which underlies the first group, and electrodes each clamped between a pair of associated piezoelectric elements.

DESCRIPTION OF THE PREFERRED EMBODIMENTS

Figure 1:
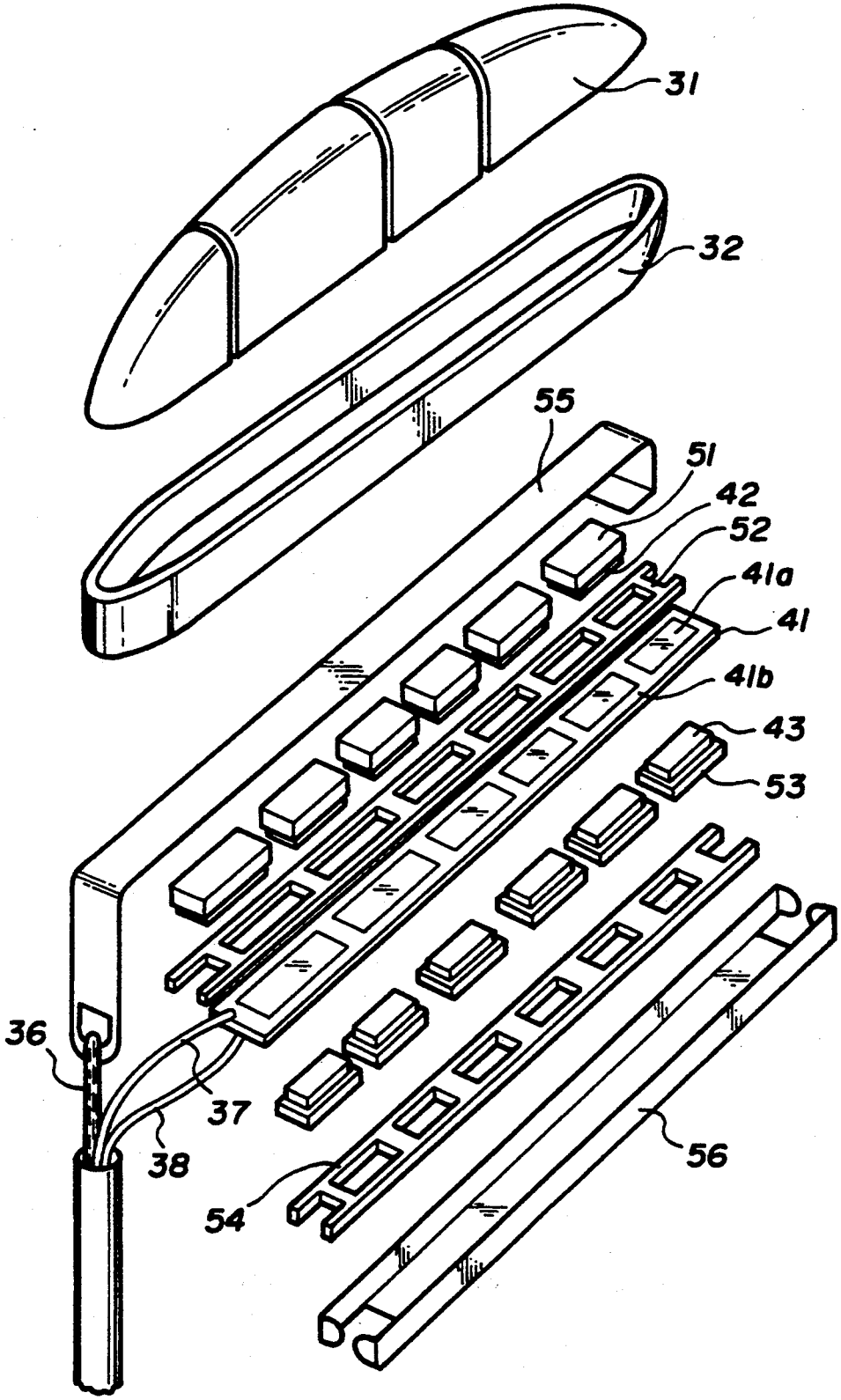
FIG. 1 is a perspective view of the main part of one embodiment of the pickup unit in accordance with the present invention in a disassembled state.
Figure 2:
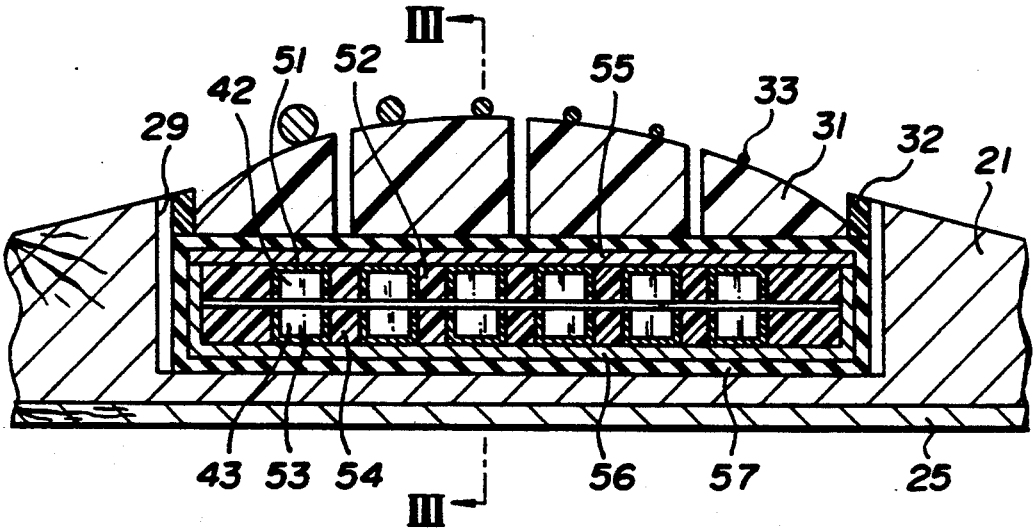
FIG. 2 is a transverse sectional view of the pickup unit shown in FIG. 1.
Figure 3:
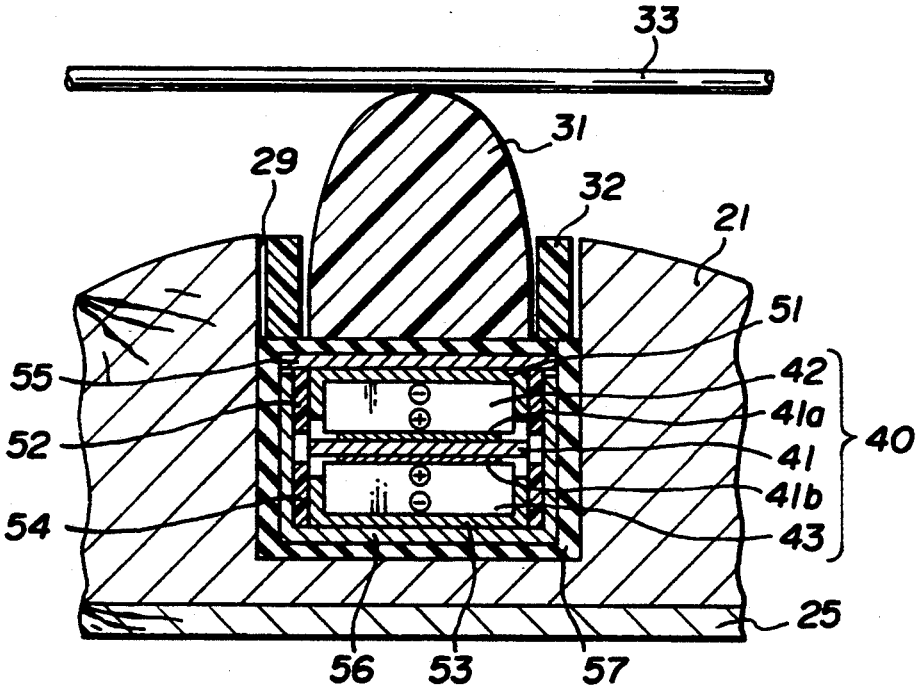
FIG. 3 is an enlarged view of the section taken along a line III—III in FIG. 2.

One embodiment of the pickup unit in accordance with the present invention is shown in FIGS. 1 through 3, in which the pickup unit includes a wooden bridge 21 mounted to a surface board 25 of the body of an electroacoustic guitar as best seen in FIG. 2. An elongated groove 29 is formed in the top face of the bridge 21 in order to accommodate a piezoelectric assembly 40 in position. A string holder 31 of a round top face is supported on the piezoelectric such that the piezoelectric assembly 40 is clamped between the bridge 21 and the string holder 31.

In the case of the illustrated example, six strings 33 are held in tension in contact with the top face of the string holder 31 the string holder 31 takes the form of an inverted boat is and generally made of urea resin or cow bone. The string holder 31 is longitudinally divided into four pieces. However, it may be made up of six pieces. The string holder 31 is accommodated in a string holder casing 32 given in the form of an elongated endless belt.

The piezoelectric assembly 40 is in a dual layer arrangement of piezoelectric elements, i.e., it is made up of upper and lower groups of components demarcated by a central base strap 41 which extends in the longitudinal direction of the string holder 31. The base strap 41 is provided, in its upper and lower faces, with six, spacedly aligned windows for each face. The windows are occupied by electrodes, preferably, positive electrodes. In another words, six positive electrodes 41a are present on the upper face of the base strap 41, and six positive electrodes **41*b* are present on tile lower face of the base strap 41. The six positive electrodes 41*a* on the top face corresponds in position to the six positive electrodes 41*b*** on the bottom face.

The upper group includes six piezoelectric elements 42 held in contact with the six positive electrodes **41*a* on the upper face of the base strap 41. The piezoelectric elements 42 are covered with metal caps (steel caps) 51 which are received in aligned windows of a lattice frame 52 which extends in the longitudinal direction of the string holder 31. The windows in the lattice frame 52 correspond in position to the six positive electrodes 41*a* on the upper face of the base strap 41 so that the piezoelectric elements 42 is kept in correct contact with the associated positive electrodes 41*a* on the base strap 41. The lattice frame 52 is made of resin so that adjacent piezoelectric elements 42** is electrically insulated from each other.

Similarly, the lower group includes six piezoelectric elements 43 held in contact with the six positive electrodes **41*b* on the lower face of the base strap 41. The piezoelectric elements 43 are covered with metal caps 53 which are received in aligned windows of a lattice frame 54 which extends in the longitudinal direction of the string holder 31 substantially in parallel to the upper lattice frame 52. The windows in the lattice frame 54 correspond in position to the six positive electrodes 41*b* on the lower face of the base strap 41 so that the piezoelectric elements 43 is kept in correct contact with the associated positive electrodes 41*b* on the base strap 41. Like the upper lattice frame 52, the lower lattice frame 54 is made of resin so that adjacent piezoelectric elements 42** is electrically insulated from each other.

The piezoelectric assembly 40 of the above-described construction is received in a box-type, steel main casing 56 which is tightly closed on the upper side by a steel cover 55. That is, the piezoelectric assembly 40 is tightly clamped between the cover 55 and the main casing 56 which are soldered together and wholly covered together with a metallic foil not shown in the illustration. The entire assembly covered with the metallic foil is further wrapped with a thermally shrinkable tube which is then heated so as to firmly hold the entire assembly inside. The piezoelectric assembly 40 is about 5 mm in height and is accommodated in the groove 29 of the bridge 21 as shown in FIGS. 2 and 3.

The string holder 31 is placed atop the above-described entire assembly via the tube 57, and its component pieces are firmly united together by the string holder casing 32.

As stated above, the six strings 33 are held in tension in contact with the top face of the string holder 31 and, due to the divided construction of the string holder 31, uniform pressure acts on the upper and lower piezoelectric elements 42, 43.

Each piezoelectric element is combined with an associated positive electrode as shown in FIG. 3. More specifically, the anode of each upper piezoelectric element 42 contacts an associated upper positive electrode 41*a* on the base strap 41 with the cathode being in contact with the associated steel cap 51. Likewise, the anode of each lower piezoelectric element 43 contacts an associated lower positive electrode 41*b* on the base strap 41 with the cathode being in contact with the associated steel cap 53. Further, as shown in FIG. 1, six leads connected to the upper positive electrodes 41*a* are bundled together in connection with an upper signal cord 37 at one longitudinal end of the base strap 41. Similarly, six conductive leads connected to the lower positive electrodes 41*b* are bundled together in connection with a lower signal cord 38 near the upper signal cord 37. An earth cord 36 is connected to one longitudinal end of the cover 55. In other words, the cathodes of the upper piezoelectric elements 42 and the cathodes of the lower piezoelectric elements 43 are connected to the common earth cord 36. The three cords 36, 37 and 38 are connected to a guitar amplifier (not shown) via one or more pre-amplifiers.

As a string 33 is driven for vibration, its vibrations are transmitted to an associated upper piezoelectric element 42 via the string holder 31, and the piezoelectric element 42 issues electric signals corresponding to the vibrations after electroacoustic conversion. These electric signals are passed, via the signal cord 37, the earth cord 36 and the pre-amplifiers to the guitar amplifier which in turn generates musical tones corresponding to the vibrations of the string 33. During this process, the vibrations of the string 33 is transmitted, through the string holder 31, to the associated upper piezoelectric element 42 with a high degree of sensitivity and fidelity. As a consequence, the musical tones generated by the guitar amplifier are highly excellent in tone quality.

The lower group components of the piezoelectric assembly 40 also takes part in the above-described tone generation process. More specifically, the string vibrations induce body vibrations in the guitar because of resonance. These body vibrations take the form of corresponding low frequency vibrations of the surface board 25 of the guitar, and the low frequency vibrations of the surface board 25 are well transmitted to one or more lower piezoelectric elements 43 in the bass range via the body of the bridge 21 (see FIG. 3), and corresponding electric signals issued via electroacoustic conversion by these piezoelectric elements 43 are similarly passed to the guitar amplifier. Thus, the guitar amplifier generates musical tones corresponding to the body vibrations of the guitar. Thanks to a significant difference in frequency, there occurs no substantial resonance between the natural frequency of the piezoelectric assembly and the frequency of the body vibrations of the guitar even when the tone volumes are increased at the guitar amplifier. Thus, without the danger of harsh howling, use of the lower piezoelectric elements easily allows generation of thick bass range musical tones. Some of the lower piezoelectric elements 43 are also involved in intermittent detection of vibrations of the strings 33.

Rich and broad range musical tones are produced at the stereo amplifier by a combination of stereo generation of string vibrations via the upper piezoelectric elements 42 with monaural generation of body vibrations via the lower piezoelectric elements 43. Thus, the pickup unit in accordance with the present invention assures all-round tone generation from bass to treble range. Since the caps 51 and 52 are received on the earth side (the cap 55 and the casing 56) of the unit, musical tones are highly clear-cut in generation.

In each group, the issuance of electric signals by different piezoelectric elements can be designed quite freely. All the piezoelectric elements may be designed in common in issuing their electric signals, or adjacent piezoelectric elements may be paired in issuing of their electric signals. The upper group piezoelectric elements may be made independent of the lower group piezoelectric elements in issuing electric signals. Abundance in such combination allows wide variety in tone generation by the guitar amplifier. For example, the upper piezoelectric elements may be designed in common in issuing electric signals for the above-described monaural tone generation. The lower piezoelectric elements may be designed in a similar fashion for same purposes. Electric signals issued by each upper piezoelectric element may be blended with those issued by an associated lower piezoelectric element for the monaural tone generation.

In another form of signal blending for stereo tone generation, electric signals from adjacent upper piezoelectric elements 42 may be combined in common. For example, upper piezoelectric elements 42 for the first to third strings 33 may be combined in common, and upper piezoelectric elements for the fourth to sixth strings 33 may be combined in common so that signals from two common groups are blended together for stereo tone generation. In the other form of signal blending for stereo tone generation, electric signals from distant piezoelectric elements 42 may be combined in common. For example, upper piezoelectric elements 42 for the first, third and fifth strings 33 may be combined in common, and upper piezoelectric elements 42 for the second, fourth and sixth strings 33 may be combined in common so that signals from two common groups are blended together for stereo tone generations. All upper piezoelectric elements 42 or all lower piezoelectric elements 43 may be combined in common, respectively, for stereo tone generation.

In a particular form of signal blending, signals from the upper piezoelectric elements 42 may be divided in two for respective stereo tone generation. All lower piezoelectric elements 43 may be combined in common in issuing signals which are then added to the above-described stereo tone generation.

The upper or lower positive electrodes 41*a* (or 41*b*) may be united together into one body. Alternatively, three adjacent positive electrodes may be united together into one body, and three distant positive electrodes may be united together into one body.

In accordance with the present invention, the dual layer arrangement of piezoelectric elements assures successful detection of string and body vibrations and produces rich and voluminous musical tone generation by an electroacoustic guitar.

I claim:

1. A pickup unit for a stringed instrument having a body and a plurality of strings, said pickup unit comprising:

a bridge having a length and mounted atop said body of said instrument to which said pickup unit is to be attached;

a string holder having a length and mounted atop said bridge and extending in a direction parallel to the length of said bridge for supporting each of the plurality of strings; and a piezoelectric assembly located between said string holder and said bridge, said piezoelectric assembly including first and second groups of piezoelectric elements, said first and second groups of piezoelectric elements being spacedly aligned in a direction parallel to the length of said string holder, each of the elements of the first group substantially overlying a corresponding element of the second group in substantial alignment with an associated string, the elements in said first group being responsive to vibrations of the string holder caused by vibrations of the associated string, and the elements in said second group being responsive to vibrations of the body caused by vibrations of the associated string, whereby in response to a vibration of a string, the piezoelectric assembly produces two electrical signals which differ from each other.

2. A pickup unit as claimed in claim 1 wherein the piezoelectric assembly further comprises:

first and second group of electrodes located between and in a direction parallel to the length of said first and second groups of piezoelectric elements;

said first group of electrodes being aligned in respective contact with said first group of piezoelectric elements along the length of said first group of piezoelectric elements; and said second group of electrodes being aligned in respective contact with said second group of piezoelectric elements along the length of said second group of piezoelectric elements.

3. A pickup unit as claimed in claim 2 wherein each piezoelectric element has electrodes of opposite polarity on opposed top and bottom surfaces of each said piezoelectric element;

each piezoelectric element in the first group of piezoelectric elements substantially overlies a corresponding electrode of the first group of electrodes, and each electrode of the second group of electrodes substantially overlies a corresponding piezoelectric element of the second group of piezoelectric elements;

said bottom surface of each said piezoelectric element of said first group of piezoelectric elements is in contact with said corresponding electrode of said first group of electrodes, and said top surface of each said piezoelectric element of said second group of piezoelectric elements is in contact with said corresponding electrode of said second group of electrodes; and said top surface of each said piezoelectric element of said first group of piezoelectric elements is covered with a metal cap, and said bottom surface of each said piezoelectric element of said second group of piezoelectric elements is covered with a metal cap.

4. A pickup unit as claimed in claim 2 wherein adjacent piezoelectric elements within each said group of piezoelectric elements are electrically insulated from each other.

5. A pickup unit as claimed in claim 2 wherein said first and second groups of electrodes are arranged on opposite faces of an elongated, insulating base strap.

6. A pickup unit as claimed in claim 1 wherein said piezoelectric assembly is demarcated by a base strap to form a dual layer arrangement.

7. A pickup unit as claimed in claim 2 wherein the piezoelectric assembly is of a bimorph type.

* * * * *